US008937574B2

(12) United States Patent
Edward et al.

(10) Patent No.: US 8,937,574 B2
(45) Date of Patent: Jan. 20, 2015

(54) LIGHTWEIGHT AIR-COOLED TRANSMIT/RECEIVE UNIT AND ACTIVE PHASED ARRAY INCLUDING SAME

(75) Inventors: Brian J. Edward, Jamesville, NY (US); Peter J. Ruzicka, Auburn, NY (US); Neil C. Smith, East Syracuse, NY (US); Carl E. DeWire, Manlius, NY (US)

(73) Assignee: Saab Sensis Corporation, East Syracuse, NY (US)

( * ) Notice: Subject to any disclaimer, the term of this patent is extended or adjusted under 35 U.S.C. 154(b) by 342 days.

(21) Appl. No.: 13/469,379

(22) Filed: May 11, 2012

(65) Prior Publication Data

US 2012/0218149 A1 Aug. 30, 2012

Related U.S. Application Data

(63) Continuation-in-part of application No. PCT/US2010/050479, filed on Sep. 28, 2010.

(60) Provisional application No. 61/260,632, filed on Nov. 12, 2009.

(51) Int. Cl.

| | |
|---|---|
| ***H01Q 3/00*** | (2006.01) |
| ***H01Q 21/00*** | (2006.01) |
| ***H01Q 21/08*** | (2006.01) |

(52) U.S. Cl.

CPC ..... *H01Q 21/0025* (2013.01); *H01Q 21/08* (2013.01)

USPC ..... 342/368

(58) Field of Classification Search

USPC ..... 342/368, 357.77, 357.75

See application file for complete search history.

(56) References Cited

U.S. PATENT DOCUMENTS

| | | | | |
|---|---|---|---|---|
| 5,488,380 | A | 1/1996 | Harvey et al. | |
| 2005/0270250 | A1 | 12/2005 | Edward et al. | |
| 2008/0303716 | A1 | 12/2008 | Gallivan et al. | |
| 2010/0066631 | A1 | 3/2010 | Puzella et al. | |
| 2010/0141350 | A1 | 6/2010 | Sasaki et al. | |
| 2010/0157531 | A1 | 6/2010 | Mason et al. | |
| 2010/0245179 | A1 * | 9/2010 | Puzella et al. | 343/702 |

FOREIGN PATENT DOCUMENTS

| | | | |
|---|---|---|---|
| JP | 07297622 | A * | 11/1995 |
| WO | 2008/129923 | | 10/2008 |
| WO | 2009/037692 | | 3/2009 |

* cited by examiner

*Primary Examiner* — Harry Liu

(74) *Attorney, Agent, or Firm* — Burr & Brown, PLLC

(57) ABSTRACT

A light-weight, air-cooled transmit/receive unit is provided, including a first external cover member, an opposed second external cover member, and a central housing unit, including thermal management means, interposed between the first and second external cover members. A transmit/receive circuit board, including components and an integrated and common radiating element for at least one channel, is interposed between a first surface of the central housing unit and the first external cover member, and a controller circuit board and a power converter circuit board are interposed between an opposed second surface of the central housing unit and the second external cover member.

14 Claims, 6 Drawing Sheets

LIGHTWEIGHT AIR-COOLED TRANSMIT/RECEIVE UNIT AND ACTIVE PHASED ARRAY INCLUDING SAME

CROSS-REFERENCE TO RELATED APPLICATIONS

This application is a continuation-in-part of International Application No. PCT/US2010/050479 filed Sep. 28, 2010, which designated the United States, and which in turn is the non-provisional of U.S. Provisional application Ser. No. 61/260,632, filed Nov. 12, 2009, the entireties of which is incorporated herein by reference.

FIELD OF THE INVENTION

The present invention relates to sensor, communications, and electronic warfare systems using active phased array antennas. The host system platforms may be ground-based stationary or mobile platforms, ship-board, or airborne. The present invention is particularly beneficial to such systems that are subject to stringent weight and volumetric constraints, and are cooled by convective air.

BACKGROUND OF THE INVENTION

Next generation radar systems, which are readily integrated into their host platforms and which perform multiple missions and deliver higher levels of performance with high levels of operational flexibility, employ active phased array antennas. Active phase arrays are configured from a plurality of individual radiating elements, each having phase and amplitude states that can be electronically controlled. The radiated energy from the collection of elements combines constructively (focused) so as to form a beam. The angular position of the beam is electronically redirected by controlling the elements' phases. Controlling both the elements' phases and amplitudes alters the shape of the beam. Each individual radiator of an active phased array antenna includes an initial low noise amplifier for receive mode and a final power amplifier for transmit mode, in addition to the phase and amplitude control circuitry. These active components and their support circuitry, associated with one or more array elements, are assembled into transmit/receive (T/R) units.

Most host platform limitations, especially mobile platforms, require that the radar system be assembled with components and structures having a light weight and a small volume, which operate in a reliable manner, and which are easy to maintain and/or replace. In addition, the inclusion of active components requires an effective thermal management system, preferably using air to minimize cooling system power consumption and to maximize reliability.

Conventionally, the components and circuits within the T/R units are disposed in a single plane extending rearward from the radiating element surface of the array. Consequently, the T/R units tend to be voluminous. Heat removal from the active components is initially transported by conduction within the T/R unit housing. Conventionally, the housing has a substantial metallic content so as to conduct the heat away from the components to a remote area for final heat removal. This metallic content typically leads to the T/R unit being heavy. Many active arrays employ liquid as the cooling media. The liquid is either introduced into the T/R unit or confined to an array structure that must be in close intimate contact with the T/R unit to allow effective cold plate conductive heat transfer. Due to the size, weight, and cooling techniques characteristic of conventional T/R unit designs, the integration of phased arrays incorporating such units into their platforms is problematic.

SUMMARY OF THE INVENTION

It is an object of the present invention to overcome the problems of the prior art by providing a compact, line replaceable, light-weight, air-cooled transmit/receive (T/R) unit for assembling high performance phased array antenna systems that are readily incorporated into their host platforms.

The T/R unit according to the present invention arranges the components and circuitry onto two parallel planes with an air coolant channel between them. Employing two planes reduces the depth of the unit compared to the conventional design. Additionally, locating the components and circuitries on two separate parallel planes provides improved electrical isolation therebetween. If the power converter and the Radio Frequency (RF) circuits are respectively located on each of the two planes, then they can be effectively shielded from each other to preclude detrimental signal coupling via radiation. However, short, intimate interconnects can be formed between them to effect the desired power and signal transfer. The length of this interconnect need only span the separation of the two planes as set by the cooling channel, being on the order of a fraction of an inch. The coolant passes between the two planes, directly beneath the heat generating components, so that minimal metallic material is required to promote heat conduction to the coolant.

The use of air as a coolant obviates concerns with respect to leaks and reliability issues that are otherwise characteristic of liquid cooling systems, has a lower cost, and is lighter in weight. The size, weight, and cooling techniques of the present invention enable effective and efficient active array integration into their host platforms.

According to a first aspect of the present invention, a light-weight, air-cooled transmit/receive unit is provided, comprising a first external cover member, an opposed second external cover member, a central housing unit, including thermal management means, interposed between the first and second external cover members, a transmit/receive circuit board, including circuitry and an integrated radiating element for at least one channel, interposed between a first surface of the central housing unit and the first external cover member, and a controller circuit board and a power converter circuit board interposed between an opposed second surface of the central housing unit and said second external cover member.

According to another aspect of the present invention, an active phased array is provided, including at least one array structure having a plurality of beamformer, power and communications harness raceways extending along a longitudinal (or lateral) direction thereof and protruding from a first surface of the array structure, at least one air supply manifold, located proximate an opposed second surface of the array structure, including a plurality of air coolant supply ducts extending along the longitudinal or lateral direction of the array structure and in fluid communication with a plurality of light-weight, air-cooled transmit/receive units via a plurality of openings passing from the first to the second surface of the array structure, wherein the plurality of light-weight, air-cooled transmit receive units are positioned on the array structure in between the harness raceways. Each light-weight, air-cooled transmit/receive unit comprises a first external cover member, an opposed second external cover member, a central housing unit, including thermal management means, interposed between the first and second external cover members, a transmit/receive circuit board, including circuitry and an integrated radiating element for at least one channel, interposed between a first surface of the central housing unit and the first external cover member, and a controller circuit board and a power converter circuit board interposed between an opposed second surface of the central housing unit and the second external cover member. An array ground plane is positioned above the plurality of light-weight, air-cooled transmit receive units and arranged so that the radiating members extend outwardly through corresponding openings in the ground plane, and at least one removable radome panel is provided, covering the array, including the radiating elements and the array ground plane, and extending over the span of the array structure.

The light-weight, air-cooled T/R unit according to the present invention is light in weight and realizes efficient thermal management via the use of convective air cooling. The electronics are positioned on either side of the central housing unit, which not only serves as means for thermal management, but also electrically isolates the respective circuitry to preclude radiated emissions interference, facilitates direct, low-loss interconnects, and provides for a minimum unit volume. The radiating element is integral with respect to the T/R circuit board, which permits continuation of the RF circuit conductors and eliminates the need for additional connectors, improves performance and mechanical reliability, lowers the costs and provides for better dimensional stability within accurate tolerances. The T/R unit is environmentally sealed to prevent contamination of the components. The T/R unit also provides interface features that enable higher level assembly in an array structure, to secure the T/R units to the structure and set spacing and stabilize the T/R units within the array. The open architecture provided by the present invention provides for performance growth, enables the ready adoption of alternative components, and is amenable to commercially established manufacturing processes.

The present invention offers several cost advantages as well, with a reduced number of parts and low materials costs, resulting in low acquisition and support cost advantages. These cost saving advantages, coupled with the other size and efficiency advantages described above, overcome the drawbacks in the prior art and offer significant and tangible improvements over conventional designs. Such T/R units have not been heretofore known in the art.

BRIEF DESCRIPTION OF THE DRAWINGS

For a better understanding of the nature and objects of the present invention, reference should be made to the following detailed description of a preferred mode of practicing the present invention, read in connection with the accompanying drawings, in which.

DETAILED DESCRIPTION OF THE INVENTION

Figure 1:
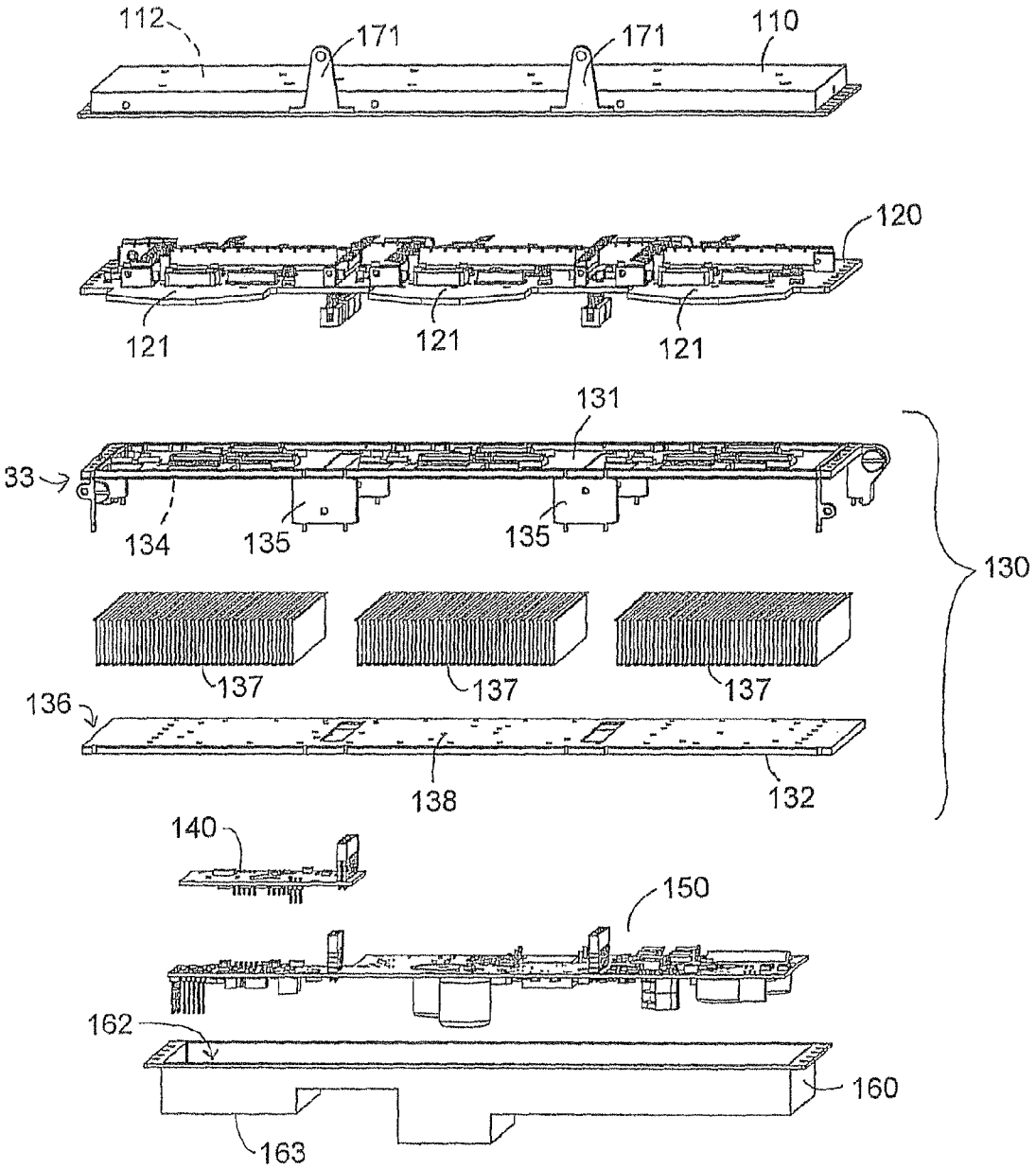
FIG. 1 is an exploded view of a light-weight, air-cooled T/R unit according to one embodiment of the present invention, including 3 channels.
Figure 2:
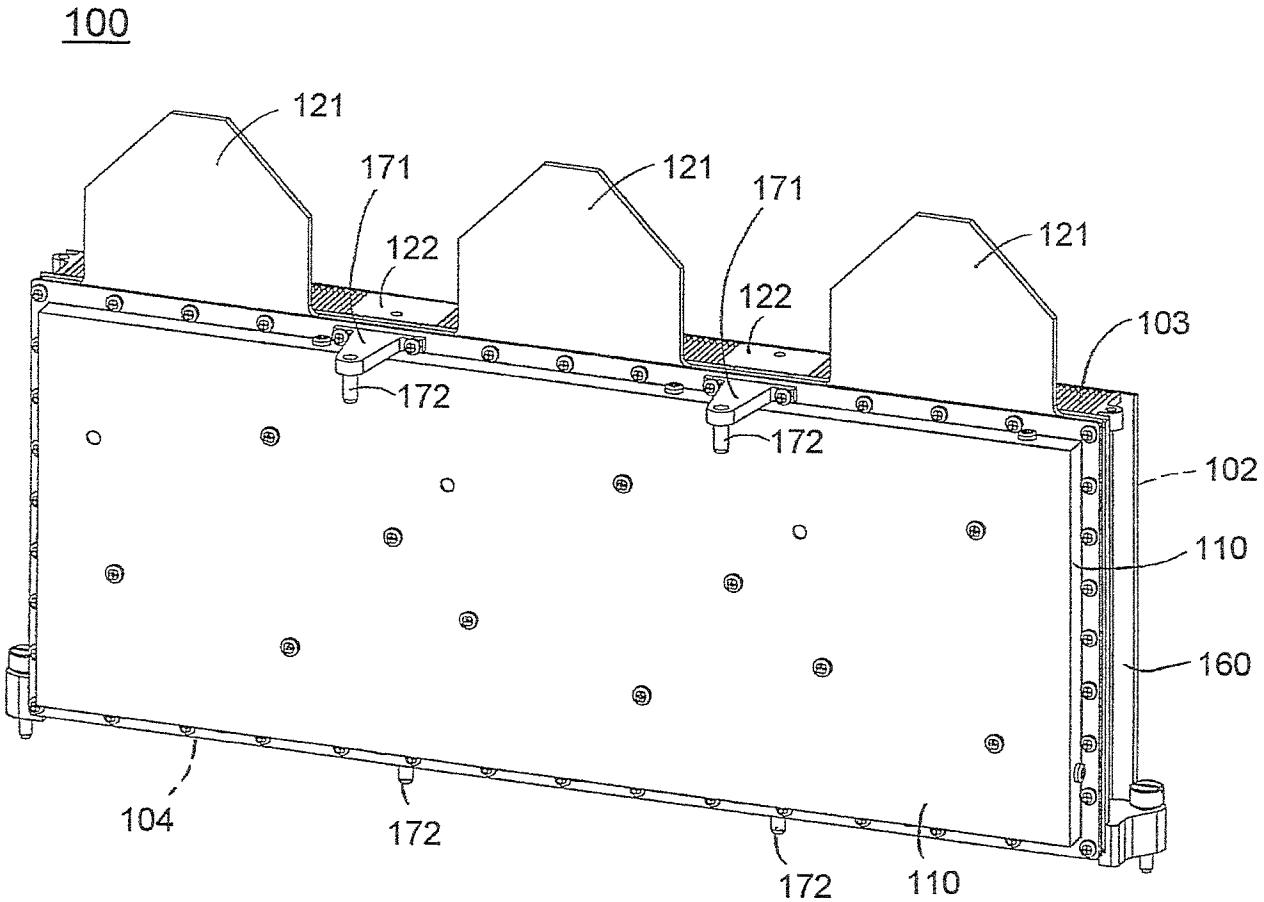
FIG. 2 is a perspective, assembled view of the T/R shown in FIG. 1, viewed from the first external cover side, with the radiating elements oriented in a vertical position.
Figure 3:
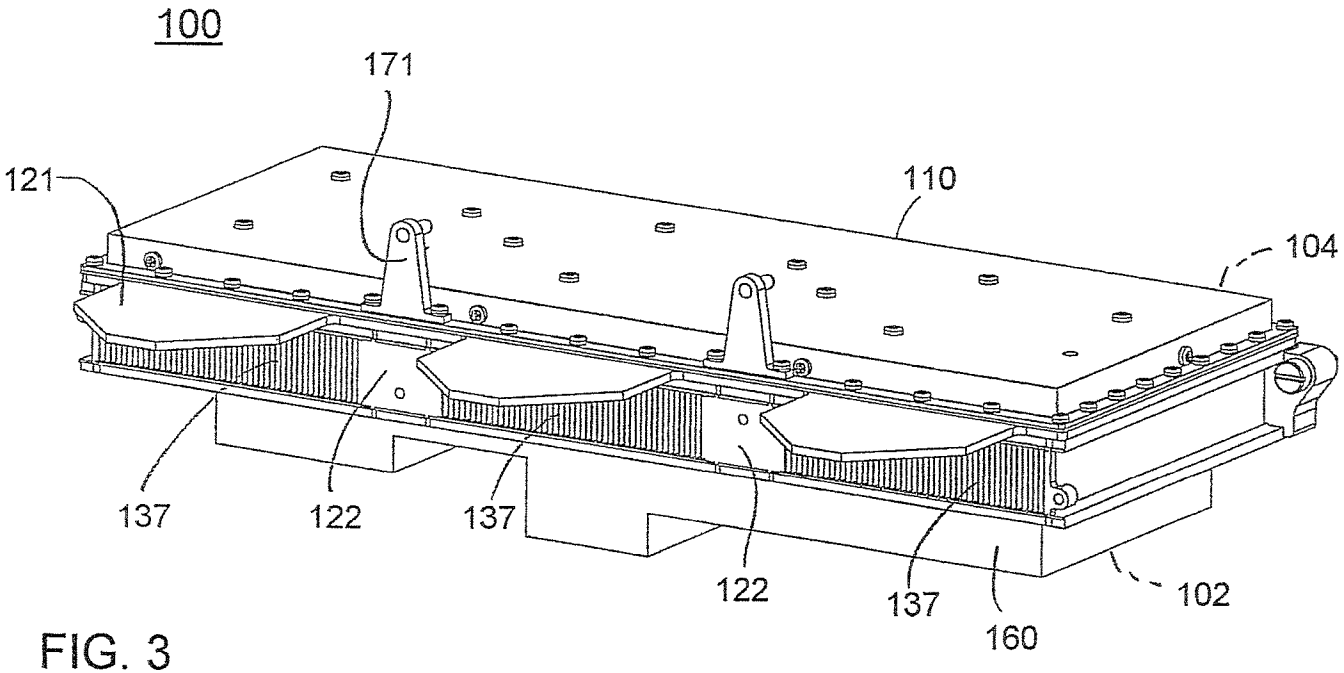
FIG. 3 is a perspective, assembled view of the T/R shown in FIG. 1, viewed from the first (front) face from which the radiating elements extend.
Figure 4:
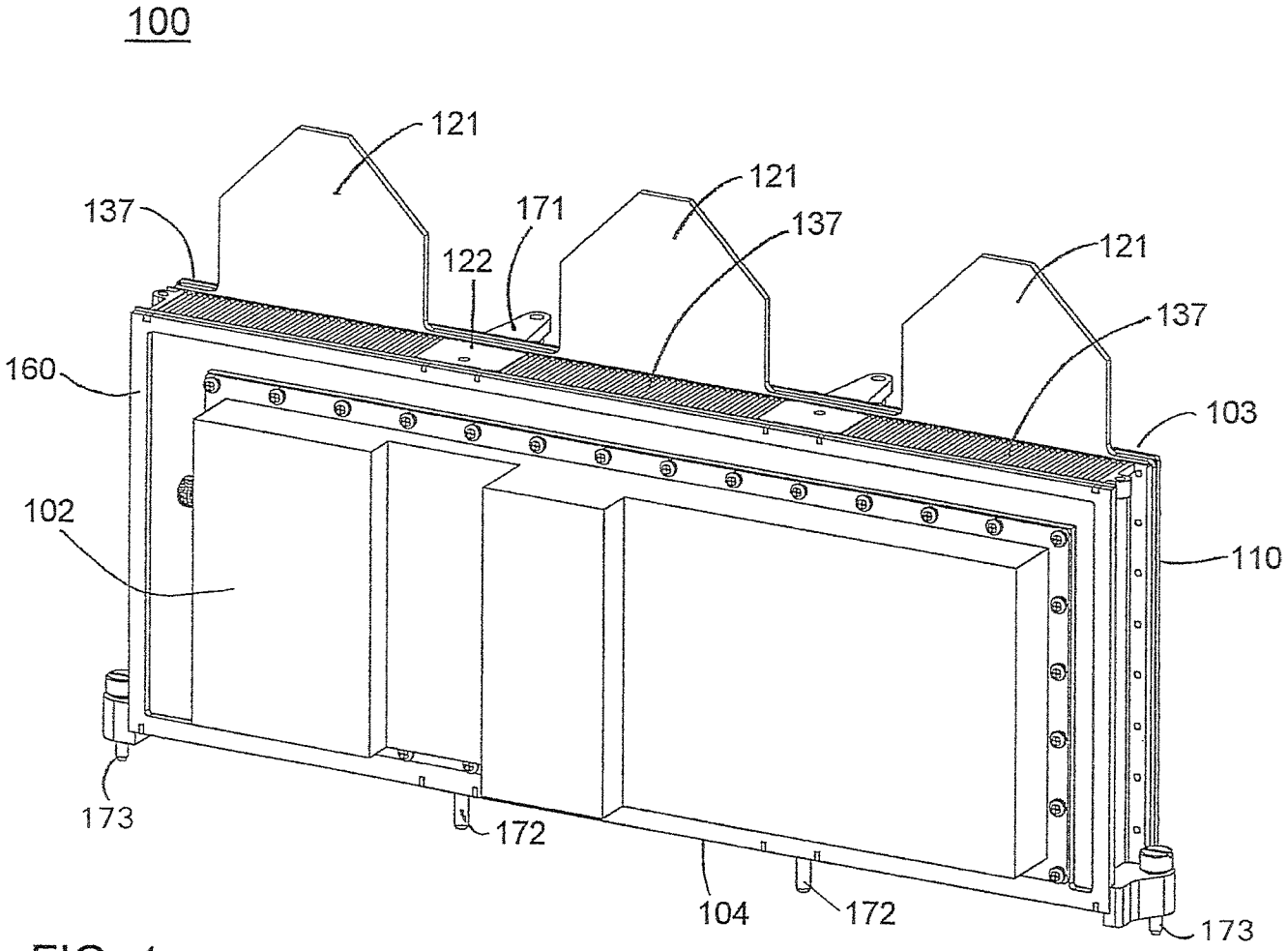
FIG. 4 is a perspective, assembled view of the T/R shown in FIG. 1, viewed from the power converter cover side, with the radiating elements oriented in a vertical position.
Figure 5:
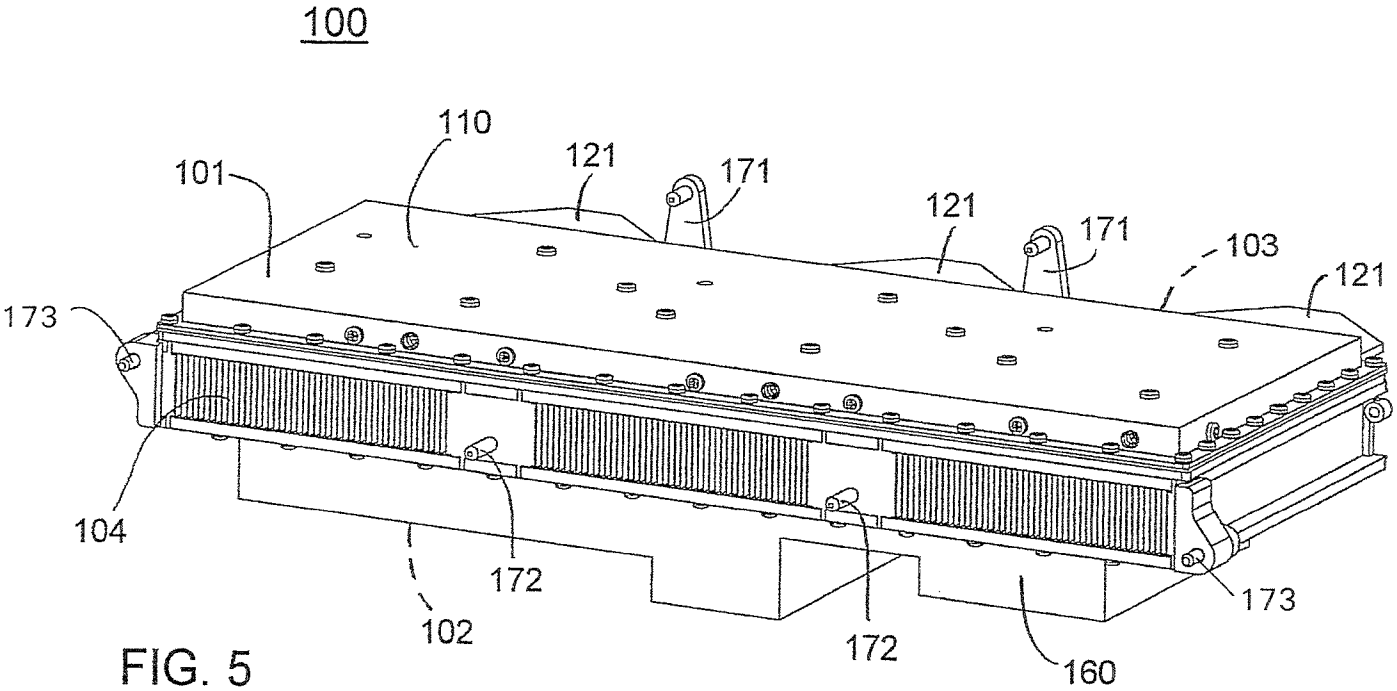
FIG. 5 is a perspective, assembled view of the T/R shown in FIG. 1, viewed from the second (rear) face, opposing the first (front) face from which the radiating elements extend.

FIG. 1 is an exploded view of a light-weight, air-cooled T/R unit 100 according to one embodiment of the present invention, which includes 3 channels. It should be noted that although the embodiments shown and described herein relate to a 3-channel unit, and to an array including a plurality of such 3-channel units, any number of one or more channels could be provided without deviating from the scope of the present invention. The features of the T/R unit 100 shown in the exploded view of FIG. 1 are also shown in the assembled state in FIGS. 2-5 and described in detail below.

The T/R unit 100 includes a first external cover 110, such as an RF cover, a T/R circuit board 120 supporting transmit/receive circuitry and components and having three integrated radiating elements 121 extending therefrom, and a central housing unit 130. The central housing unit 130 includes a first plate 133 and a second plate 136, and sections of thermal management means, which comprise an interconnected extended surface, such as, for example, corrugated fin stock heat exchanger units 137, one per channel, sandwiched between the inner surface 134 of the first plate 133 and the inner surface 138 of the second plate 136 so as to form integral air cooling ducts. A controller circuit board 140 and power converter circuit board 150 are provided facing the outer surface of the second plate 136, which corresponds to a second surface 132 of the central housing unit 130. A second external cover 160 is provided on the side of the power converter facing away from the central housing unit 130.

The components of the assembly shown in FIG. 1 are pre-fabricated, arranged, stacked in order and fixed together using bonding materials and fasteners, for example, as shown in more detail in FIGS. 2-5. The overall T/R unit 100 structure is sealed via gaskets or welds to form an environmentally secure package, whereby the internal electronic components are not subject to environmental contamination.

The various components of the light-weight, air-cooled T/R unit 100 according to present invention are described in more detail individually below.

The First External Cover 110 and Second External Cover 160

The first and second external covers 110, 160 are formed from a light-weight, electrically conductive, corrosion resistant, non-porous material, suitable examples of which include, but are not limited to aluminum and electrically/thermally conductive plastics. The peripheral rim extending at substantially right angles from the first exterior cover 110 aligns with and meets a corresponding surface 131 of the central housing 130 so as to encapsulate the components within and between the cover 110 and the central housing 130. Similarly, the peripheral surface extending at substantially right angle from the second exterior cover 160 aligns with and meets a corresponding surface 132 of the central housing 130 so as to encapsulate the components within and between 160 and 132. Gaskets or other sealing means such as adhesives can be provided therebetween proximate the joining peripheral surfaces in order to ensure that sufficient environmental sealing is achieved when the T/R unit 100 is assembled and sealed. Alternatively, or in addition, the peripheral rim joining surfaces can be welded to provide sufficient sealing protection. The electrically conductive first and second covers 110, 160 provide transmit/receive circuit, controller circuit, and power converter circuit shielding of each transmit/receive unit from that of other transmit/receive units.

The T/R Circuit Board 120

The T/R circuit board 120 includes active and passive transmit/receive components and offers low-loss interfaces, providing direct connections with the components provided thereon and with the integrated radiating elements 121.

Components interconnected by the T/R circuit board include, but are not limited to, Monolithic Microwave Integrated Circuit (MMIC) transmit and receive amplifiers plus phase and amplitude control networks, circulators, filters, capacitors, inductors, resistors, and voltage regulators. In one embodiment, the T/R circuit board is multi-layer fabricated by standard commercial processes. This provides for low T/R unit manufacturing costs, and readily enables modifications to accommodate alternative components to counter obsolete parts or to advantageously incorporate new technologies. As a result of the direct low-loss interfaces, minimum DC power and minimum RF signal power are dissipated, yielding high performance, efficient T/R unit operation.

High heat dissipative components interconnected by the T/R circuit board 120 may be positioned into cut-outs in the circuit board so as to be in direct thermal communication with the central housing's first plate 133 surface 131 thereby promoting heat removed from the components for high performance and reliable operation.

The Central Housing Unit 130

The central housing unit 130 is a principal feature of the present invention that enables the realization of an overall light-weight, low volume T/R unit which utilizes air-cooled thermal management and which can be readily integrated into an array structure. The central housing unit provides means for thermal management via the convective air cooling system provided thereby, plus also electrically isolates the respective circuitry on the T/R board 120 from that of the controller 140 and power converter 150 to preclude radiated emissions interference.

The central housing unit 130 is constructed from light-weight, high thermally and electrically conductive materials. A small quantity of parts is used to form the housing unit 130, including two plates, corrugated fin stock sections, and only a few brackets or spacers 135. Accordingly, it is possible to provide a significantly lighter weight, lower cost housing unit 130 than any that had heretofore been known in the industry.

The central housing unit 130 has a first surface 131 which faces the bottom surface of the T/R circuit board 120 and interfaces therewith, and an opposed second surface 132 which faces and interfaces with the upper surface of the power converter 150 and controller 140. The central housing unit 130 itself includes a first plate 133 whose outer surface corresponds to and defines the first surface 131 of the unit 130, a second plate 136, whose outer surface corresponds to and defines the second surface 132 of the unit 130, and a plurality of air-passing thermally conductive high surface area thermal members 137, such as corrugated fin stock, sandwiched between the inner surface 134 of the first plate 131 and the inner surface 138 of the second plate 136 to serve as heat exchangers and aid in the cooling of the T/R unit 100. The number of heat exchanging sections 137 typically, but not necessarily, corresponds to the number of radiating elements and channels provided per T/R unit, which is 3 according to the embodiment shown in FIGS. 1-5.

The first and second plates 131, 132 are preferably made from light-weight, high thermally and electrically conductive materials with appropriate thermal expansion coefficients, suitable examples of which include, but are not limited to, aluminum, magnesium, titanium, metal matrix materials including metal-ceramic composites, thermally and electrically conductive plastics, and may also include embedded thermal conductivity enhancements such as, for example, graphite and diamond, and other suitable materials. Likewise, the heat exchanging sections 137 are also made from the same types of light-weight, thermally conductive materials described above. Preferably, all of the parts of the housing 130 are made from the same material type in order to ensure matched thermal expansion characteristics.

The plates 131 and 132 may be cast or machined from the desired materials described above having rough cut features, and are economically bonded to one another, with the heat exchangers interposed in the precise location, using dip brazing, for example. The critical features and topographical surfaces are post-machined using known techniques. In that manner, the critical geometries can be precision controlled within tight tolerances.

The first surface 131 of the housing unit 130, which corresponds to the outer surface of the first plate 133, has precision surface topography to correspond to the topography of the bottom surface of the T/R board 120 and its components for direct mounting thereon. Similarly, the second surface 132 of the housing unit 130, which corresponds to the outer surface of the second plate 136, has precision surface topography to correspond to the topography of the upper surface of the power converter 150 and controller 140 and their components for direct mounting thereon. This structural relationship facilitates short, intimate interconnects between the T/R circuit board 120 and the power converter 150 and the controller 140 to effect desired power and signal transfer with minimal detrimental parasitic inductance and capacitance effects that would otherwise be suffered in prior art structures. In one embodiment the interconnects between the T/R circuit board 120 and the power converter 150, controller 140, are realized by connectors located within the volume between heat exchanger sections 137.

The direct connection between the central housing unit 130 and the T/R board 120, as well as between the central housing 130 and the controller 140/power converter 150, facilitates efficient air cooling with low thermal gradients, as explained in detail below, providing effective cooling with an optimized balance of pressure drop and heat transfer for low overhead forced air convection cooling that minimizes overhead prime power requirements.

The Controller 140 and Power Converter 150

The controller 140 translates array controller commands to the respective T/R electronics' mode, amplitude and phase states, and may apply phase and amplitude correction factors. The controller 140 also provides an event timing for the power converter 150, for example, DC current pre-charge prior to transmit mode initiation. The result of the DC current pre-charge is the elimination of voltage supply droop at the beginning of the transmit signal and consequential transmit RF signal distortion.

The power converter 150 has a high power density and high efficiency and converts AC to multiple DC voltages. The power converter 150 provides for energy storage at high voltage to eliminate the need for banks of electrolytic capacitors and their attendant volume and reliability issues. An extreme power density of 2500 W can be supplied from less than 1 pound of weight. Significant power reserve is provided to support phased array system performance growth via transmit power increases. In addition, the software control of power converter output voltages is available to readily effect alteration of voltage levels to thereby accommodate multiple transmit power amplifier technology options.

In one embodiment, the power converter and controller circuit boards are multi-layer fabricated by standard commercial processes. The power converter and controller may be separate circuit boards or combined into a single circuit board.

High heat dissipative components of the power converter 150 may be positioned into cut-outs in the circuit board so as to be in direct thermal communication with the central housing's second plate 136 surface 132 thereby promoting heat removal from the components for high performance and reliable operation.

Active Phased Array 200

Figure 6:
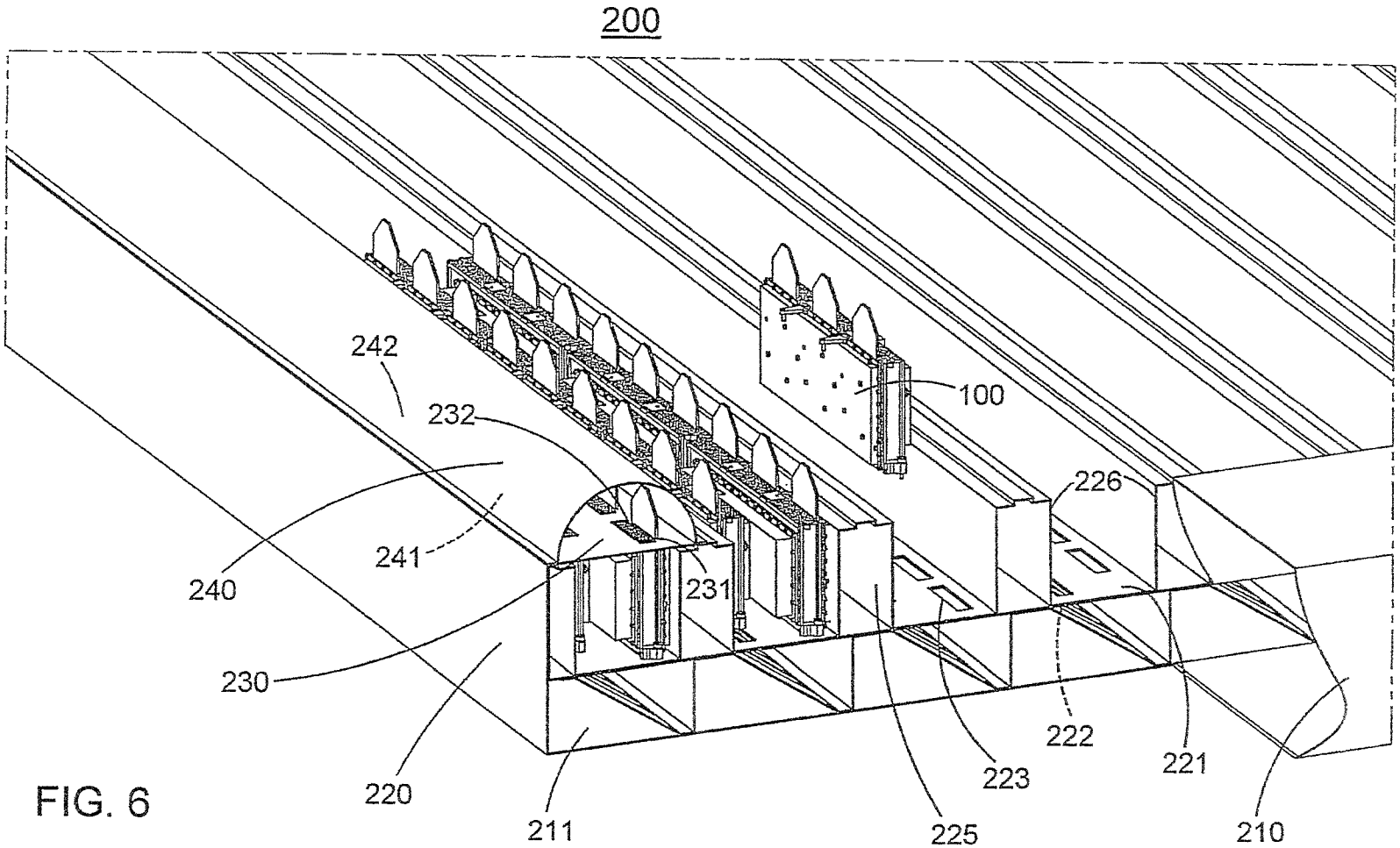
FIG. 6 is a perspective view of an active array including a plurality of the T/R units according to FIGS. 1-5.

As shown in FIG. 6, a plurality of the T/R units 100 described above are assembled into an array structure. The active phased array 200 includes an array structure 220 having a plurality of beamformer, power and communications harness raceways 225 extending along a longitudinal direction thereof and protruding from a first (i.e., T/R unit receiving) surface 221 of the array structure 220. A plurality of air coolant supply ducts 211 extend along the longitudinal direction being integral to the array structure 220. An air supply distributor 210 is in fluid communication with the ducts 211, and can be a separate component or integral with respect to the array structure 220, the distributor and ducts together constituting the air supply manifold. The T/R receiving surface 211 is in fluid communication with the air supply ducts 211 via a plurality of openings 223 passing from the second surface 222 to the first surface 221 of the array structure 220. In an alternative embodiment, the raceways 225 and the air coolant supply ducts 211 may extend along a lateral direction.

A plurality of light-weight, air-cooled T/R units 100 are positioned on the array structure 220 in channels 226 between the harness raceways 225. The positioning pins 172 extending from the first face 103 of the T/R unit 100 (see, e.g., FIG. 2) engage with receiving portions in the array structure 220 to provide alignment and stability within the array 200. Retention features 173 extending from the second face 104 of the T/R unit (see FIG. 4) engage with corresponding receptors within surface 221 to provide securing of the T/R units to the array structure 220.

The air cooling function of the central housing unit 130 of the T/R unit 100 is realized in the following manner. The second face 104 of the T/R unit 100 (see, e.g., FIG. 5) is positioned within the channel 226 between harness raceways 225 so as to matably engage with the openings 223 in the array structure 220, whereby the air from the air supply ducts 211 enters from the second face 104 of the T/R unit 100 and passes through the heat exchanging portions 137 of the central housing unit 130, which are open and exposed at the second face 104 of the T/R unit 100 (see also FIG. 5). Likewise, the heat exchanging portions 137 of the central housing unit 130 are also open and exposed at the first face 103 of the T/R unit 100 (see also FIG. 5).

Heat generated by the internal components of the T/R unit is transferred from the heat exchanging sections 137 into the air passing through by forced convection. The heated air is then expelled at the front (i.e., first face 103) of the T/R unit. Since the temperature of the air cooled heat exchanging sections is lower than the electronic components populating the T/R unit, heat flows by conduction from the components through the T/R unit central housing 130 and into the heat exchanging sections 137. The path length from the heat-generating electronic components to heat exchanging sections 137 is short and direct, and since the housing material is selected to have high thermal conductivity, only a low temperature gradient exists between the electronic components and the heat exchangers 137. Low component temperatures yield higher performance, and ensure reliable operation of the T/R unit 100. The T/R unit according to the present invention could be equally implemented so as to allow coolant air to be drawn in from the front (i.e., first face 103) of the T/R unit and exhausted at its rear (second face 104).

Array ground plane 230 (see e.g. FIG. 6) functions include mechanical duties such as array structure raceway 225 bracing, T/R unit 100 retention, radome panel 240 attachment, plus sealing the array from environmental contaminants. Electrically the ground plane 230 operates in conjunction with the T/R unit radiating elements 121 to realize desirable radiation properties, plus shields the array from detrimental electromagnetic phenomena such as lightning. A plurality of openings 231 in the ground plane align with and permit penetration by the T/R unit radiating elements 121. Additionally a plurality of openings 232 in the ground plane align with the T/R units' heat exchanger sections 137 to accommodate unimpeded flow of the air coolant through the T/R units for exhaust behind the radome panel 240. The flow of air behind the radome provides a thermal barrier between the radome's inner surface 241 and T/R units 100 thereby limiting solar induced heat on the radome's outer surface 242 from being transferred to the T/R units. Additionally the exhaust air from the T/R units impinging on the radome's inner surface 241 provides for deicing and snow melt at the radome's outer surface 242.

What is claimed is:

1. A light-weight, air-cooled transmit/receive unit comprising:

a first external cover member;

an opposed second external cover member;

a central housing unit, including thermal management means, interposed between said first and second external cover members;

a transmit/receive circuit board, including components and an integrated and common radiating element for at least one channel, interposed between a first surface of said central housing unit and said first external cover member; and a controller circuit board and a power converter circuit board interposed between an opposed second surface of said central housing unit and said second external cover member, wherein said central housing unit comprises a first plate, made of a light-weight, thermally and electrically conductive material, defining said first surface of said central housing unit and haying an opposed inner surface, and a second plate, made of a light-weight, thermally and electrically conductive material, defining said second surface of said central housing unit and having an opposed inner surface.

2. The light-weight, air-cooled transmit/receive unit according to claim 1, wherein said thermal management means comprises at least one interconnected extended surface interposed between said respective inner surfaces of said first plate and said second plate.

3. The light-weight, air-cooled transmit/receive unit according to claim 1, wherein said light-weight, thermally conductive material of said first and second plates comprises at least one material selected from the group consisting of aluminum, magnesium, titanium, metal-ceramic composites, thermally and electrically conductive plastics, and thermally and electrically conductive composite matrix having thermal enhancing materials embedded therein.

4. The light-weight, air-cooled transmit/receive unit according to claim 2, wherein the thermal management means comprises at least one air passing heat exchanging unit.

5. The light-weight, air-cooled transmit/receive unit according to claim 1, wherein said T/R components are electrically shielded from circuitry of the power converter circuit board and circuitry of the controller circuit board.

6. The light-weight, air-cooled transmit/receive unit according to claim 4, wherein short, intimate interconnects provide for high fidelity power and signal transfer.

7. The light-weight, air-cooled transmit/receive unit according to claim 5, wherein said T/R circuit board provides a low-loss, connector free RF signal path.

8. A phased active array comprising:

at least one array structure having a plurality of beam-former, power and communications harness raceways extending along one of a longitudinal direction and a lateral direction thereof and protruding from a first surface of said array structure;

at least one air supply manifold, located proximate an opposed second surface of said array structure, including an air supply distributor feeding a plurality of air coolant supply ducts extending along the longitudinal direction of said array structure and in fluid communication with said array structure via a plurality of openings passing from said first to said second surface of said array structure;

a plurality of light-weight, air-cooled transmit receive units positioned on said array structure in between said harness raceways and aligned with said air coolant supply openings, each said light-weight, air-cooled transmit receive unit comprising a first external cover member;

an opposed second external cover member;

a central housing unit, including thermal management means, interposed between said first and second external cover members;

a transmit/receive circuit board, including components and a common and integrated radiating element for at least one channel, interposed between a first surface of said central housing unit and said first external cover member; and a controller circuit board and a power converter circuit board, or a combined unit including both, interposed between an opposed second surface of said central housing unit and said second external cover member;

an array ground plane positioned above said plurality of light-weight, air-cooled transmit receive units and arranged so that said radiating members extend upwardly through corresponding opening is said ground plane; and at least one removable radome panel covering said array, including said radiating elements and said array ground plane, and extending along one of the longitudinal length and the lateral length of said array structure.

9. The phased active array according to claim 8, wherein said central housing unit of said light-weight, air-cooled transmit/receive unit comprises a first plate, made of a light-weight, thermally conductive material, defining said first surface of said central housing unit and having an opposed inner surface, and a second plate, made of a light-weight, thermally conductive material, defining said second surface of said central housing unit and having an opposed inner surface.

10. The phased active array according to claim 9, wherein said thermal management means of said central housing unit of said light-weight, air-cooled transmit/receive unit comprises at least one interconnected extended surface interposed between said respective inner surfaces of said first plate and said second plate.

11. The phased active array according to claim 10, wherein the thermal management means comprises at least one fin stock unit.

12. The phased active array according to claim 10, wherein the air coolant exits said transmit/receive units and impinges upon the inner surface of the array radome.

13. The light-weight, air-cooled transmit/receive unit according to claim 1, wherein said first and second external cover members comprises at least one material selected from the group consisting of metallics, metal-ceramic composites, electrically conductive plastics, or other electrically conductive materials.

14. The light-weight, air-cooled transmit/receive unit according to claim 1, further comprising positioning pins and retention features for aligning with said array structure.

* * * * *